US010145331B2

(12) United States Patent
Daiker et al.

(10) Patent No.: US 10,145,331 B2
(45) Date of Patent: Dec. 4, 2018

(54) INTERNAL COMBUSTION ENGINE HAVING A CRANKCASE AND METHOD FOR PRODUCING A CRANKCASE

(75) Inventors: Klaus Daiker, Unterschleissheim (DE); Markus Wittmann, Bruckberg (DE); Martin Kunst, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 1603 days.

(21) Appl. No.: 13/444,220

(22) Filed: Apr. 11, 2012

(65) Prior Publication Data

US 2012/0216771 A1 Aug. 30, 2012

Related U.S. Application Data

(63) Continuation of application No. PCT/EP2010/005654, filed on Sep. 15, 2010.

(30) Foreign Application Priority Data

Oct. 14, 2009 (DE) ..... 10 2009 049 323

(51) Int. Cl.

| | |
|---|---|
| ***F02F 1/20*** | (2006.01) |
| ***C23C 4/04*** | (2006.01) |
| ***C23C 4/06*** | (2016.01) |
| ***C23C 4/18*** | (2006.01) |
| ***C23C 4/131*** | (2016.01) |
| ***C23C 4/129*** | (2016.01) |

(Continued)

(52) U.S. Cl.

CPC ..... *F02F 1/20* (2013.01); *C23C 4/04* (2013.01); *C23C 4/06* (2013.01); *C23C 4/123* (2016.01); *C23C 4/129* (2016.01); *C23C 4/131* (2016.01); *C23C 4/134* (2016.01); *C23C 4/18* (2013.01); *Y10T 29/49231* (2015.01)

(58) Field of Classification Search

CPC .. B22D 19/0009; F02F 1/20; F02F 2007/009; C23C 4/04; C23C 4/06; C23C 4/18; C23C 4/131; C23C 4/123; C23C 4/129; C23C 4/143; Y10T 29/49231

USPC ..... 123/193.2, 193.4

See application file for complete search history.

(56) References Cited

U.S. PATENT DOCUMENTS 3,620,137 A * 11/1971 Prasse ..... 92/159
3,657,078 A 4/1972 Schweikher (Continued)

FOREIGN PATENT DOCUMENTS

AT 004 434 U1 7/2001
CN 1441078 A 9/2003

(Continued)

OTHER PUBLICATIONS

English translation of Chinese Office Action dated Sep. 11, 2013 (ten (10) pages).

(Continued)

*Primary Examiner* — Marguerite McMahon
(74) *Attorney, Agent, or Firm* — Crowell & Moring LLP

(57) ABSTRACT

An internal-combustion engine has a crankcase, with at least one cylinder for accommodating a piston, the inner face of which cylinder is provided with a coating forming a running surface for the piston. The coating has a plurality of pores and the average size of the pores and/or the pore surface proportion varies over the length of the cylinder.

27 Claims, 1 Drawing Sheet

(51) Int. Cl.
*C23C 4/123* (2016.01)
*C23C 4/134* (2016.01)

(56) References Cited

U.S. PATENT DOCUMENTS

| | | | | |
|---|---|---|---|---|
| 3,749,072 | A | 7/1973 | Schweikher | |
| 4,068,645 | A * | 1/1978 | Jenkinson | 123/193.2 |
| 5,080,056 | A * | 1/1992 | Kramer et al. | 123/193.4 |
| 5,380,564 | A | 1/1995 | VanKuiken, Jr. et al. | |
| 5,466,906 | A | 11/1995 | McCune, Jr. et al. | |
| 5,626,674 | A | 5/1997 | VanKuiken, Jr. et al. | |
| 5,691,004 | A * | 11/1997 | Palazzolo et al. | 427/455 |
| 5,908,670 | A | 6/1999 | Dunkerley et al. | |
| 7,104,240 | B1 * | 9/2006 | Vuk et al. | 123/193.2 |
| 8,651,083 | B2 * | 2/2014 | Izawa et al. | 123/193.2 |
| 2003/0164150 | A1 | 9/2003 | Barbezat | |
| 2003/0192501 | A1 * | 10/2003 | Ishikawa et al. | 123/193.2 |
| 2005/0016489 | A1 * | 1/2005 | Endicott et al. | 123/193.2 |
| 2005/0044707 | A1 * | 3/2005 | Izquierdo et al. | 29/888.061 |
| 2006/0278071 | A1 | 12/2006 | Leweux et al. | |
| 2007/0092749 | A1 | 4/2007 | Heuberger et al. | |
| 2007/0143996 | A1 * | 6/2007 | Michioka | 29/888.06 |
| 2010/0031799 | A1 * | 2/2010 | Ast et al. | 83/875 |
| 2010/0108014 | A1 * | 5/2010 | Kodama et al. | 123/193.2 |
| 2012/0227699 | A1 * | 9/2012 | Perry et al. | 123/193.4 |

FOREIGN PATENT DOCUMENTS

| | | | |
|---|---|---|---|
| DE | 2 037 962 | | 2/1971 |
| DE | 195 08 687 | A1 | 10/1995 |
| DE | 195 08 687 | C2 | 5/1997 |
| DE | 198 40 117 | C2 | 8/2001 |
| DE | 10 2004 009 928 | A1 | 9/2004 |
| DE | 10 2004 002 759 | A1 | 8/2005 |
| EP | 0 568 315 | B1 | 6/1997 |
| EP | 1 340 834 | A2 | 9/2003 |
| EP | 1 762 721 | A2 | 3/2007 |
| FR | 2 924 365 | A1 | 6/2009 |
| WO | WO 97/49497 | A1 | 12/1997 |

OTHER PUBLICATIONS

Chinese Office Action dated May 6, 2014 (four (4) pages).
Zhou et al., "Foundation of Engine Engineering," Southwest Jiaotong University Press, 2009 (four (4) pages).
K. Bobzin et al., "Thermal spraying of cylinder bores with the Plasma Transferred Wire Arc process", Surface & Coatings Technology, Jun. 15, 2008, pp. 4438-4443, vol. 202, Issue 18, Elservier.
K. Bobzin et al., "Thermal Spraying of Cylinder Bores with the PTWA Internal Coating System", Proceedings of the ASME Internal Combustion Engine Division, Fall 2007 Technical Conference, ICEF07, Oct. 14-17, 2007, Charleston, South Carolina, USA. (Eight (8) pages).
Gerhard Flores, 3 Messtechnik, Semester EK 5 (5102) / PO 5 (5112) FHTE Esslingen, URL: http://www.hs-esslingen.de/static/326/3_Messtechnik.pdf [retrieved on Mar. 16, 2010]. (Eleven (11) pages).
German Office Action dated Mar. 19, 2010 including English-language translation (Ten (10) pages).
International Search Report dated Nov. 17, 2010 including English-translation (Six (6) pages).

* cited by examiner

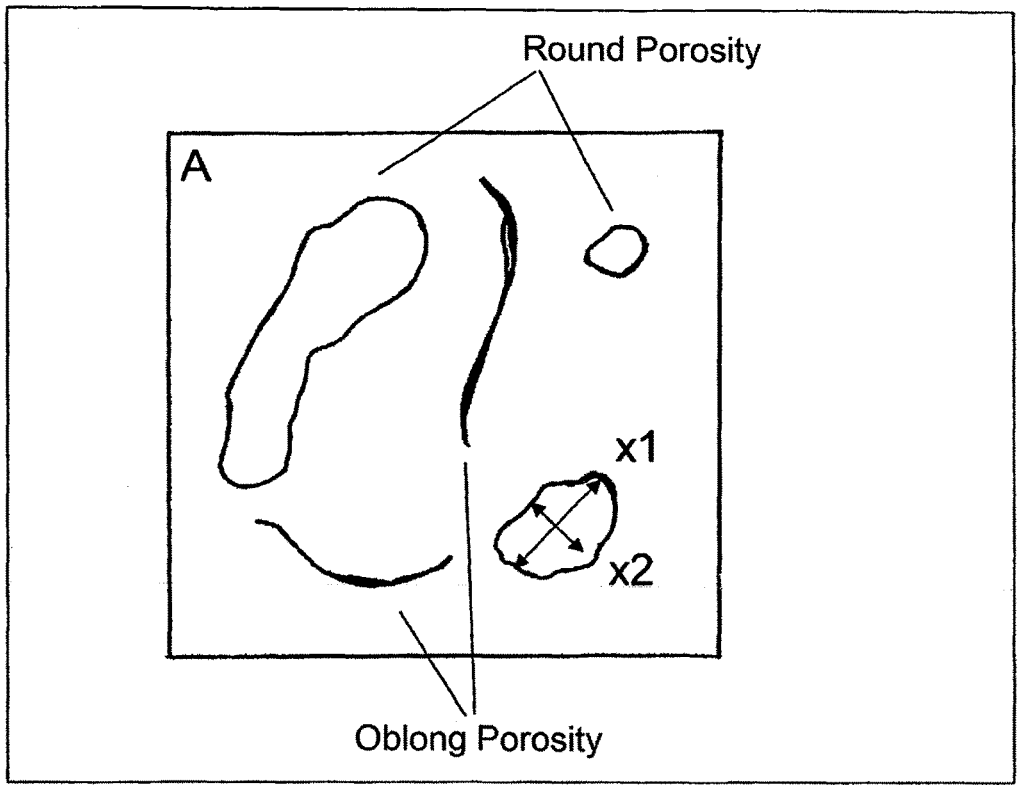
Round Porosity
A
x1
x2
Oblong Porosity

INTERNAL COMBUSTION ENGINE HAVING A CRANKCASE AND METHOD FOR PRODUCING A CRANKCASE

CROSS-REFERENCE TO RELATED APPLICATIONS

This application is a continuation of PCT International Application No. PCT/EP2010/005654, filed Sep. 15, 2010, which claims priority under 35 U.S.C. § 119 from German Patent Application No. DE 10 2009 049 323.9, filed Oct. 14, 2009, the entire disclosures of which are herein expressly incorporated by reference.

BACKGROUND AND SUMMARY OF THE INVENTION

The present invention relates to an internal-combustion engine having a crankcase with at least one cylinder to accommodate a piston, as well as to a method of producing such a crankcase.

Nowadays, crankcases for internal-combustion engines are predominantly produced of light-metal materials by die casting. In this case, Al—Si alloys are normally used. The ability to process such alloys by die casting is limited to hypoeutectic Al—Si alloys. By means of Al—Si alloys, crankshafts can be produced very cost-effectively and in large piece numbers by die casting.

A die-cast cylinder surface does not durably withstand the tribological stress in the piston/piston ring cylinder system. On the one hand, die-cast crankcases have a relatively high porosity. On the other hand, because of the relatively low strength of hypoeutectic Al—Si surfaces, their relatively high ductility and their insufficient resistance to wear, the tribological stressing capacity of hypoeutectic Al—Si surfaces makes these hypoeutectic Al—Si surfaces unsuitable for use as cylinder running surfaces. For achieving sufficient stability, one therefore frequently resorts to grey cast iron liners, which are inserted into the cylinders of light-metal crankcases.

As an alternative, light-metal crankcases are known whose cylinder running surfaces are coated with a suitable surface material. U.S. Pat. No. 5,908,670, WO 9749497, EP 568 315 B1, U.S. Pat. No. 5,626,674 and U.S. Pat. No. 5,380,564 describe corresponding coating processes, wherein first the cylinder running surface is roughened by means of a high-pressure fluid jet, and subsequently a coating in the form of melted-on metal or alloy droplets is applied, for example, by wire arc spraying, onto the roughened inner faces of the cylinders.

The relevant state of the art also includes a technical publication entitled "Thermal Spraying of Cylinder Bores with the Plasma Transferred Wire Arc Process" by K. Bobzin, F. Ernst, K. Richardt, T. Schlaefer, C. Verpoort, G. Flores, *Surface and Coatings Technology*, Volume 202, Issue 18, Jun. 15, 2008, Pages 4438-4443, as well as a publication entitled "Thermal Spraying of Cylinder Bores with the PTWA Internal Coating System" by K. Bobzin et al., *Proceedings of the ASME Internal Combustion System Division*, Fall 2007 Technical Conference, ICEF07, Oct. 14-17, 2007, Charleston, S.C., USA.

It is an object of the invention to provide an internal-combustion engine crankcase having at least one cylinder whose running surface is coated, in which case the running surface is to have a high tribological resistance.

This and other objects are achieved by an internal-combustion engine having a crankcase, which has at least one cylinder for accommodating a piston, the inner face of which cylinder is provided with a coating forming a running surface for the piston. The coating has a plurality of pores, the average size of the pores and/or the pore surface proportion varying over the length of the cylinder.

It may, for example, be useful to "adjust" the average pore size and the pore surface proportion such that the average pore size and the pore surface proportion decrease from the lower cylinder end in a direction toward the upper cylinder end. The "upper cylinder end" is the end on which the cylinder head is mounted. The lower cylinder end is the end facing away from the cylinder head.

As an alternative, it may be advantageous to adjust the size of the pores and the pore surface proportion such that they are largest in a center area of the cylinder and decrease in the directions toward both the upper and lower ends.

As an alternative, it may be provided that the pore surface proportion increases from the upper cylinder end in the direction toward the lower cylinder end and that the average pore size is essentially constant over the length of the cylinder.

As an alternative, it may be provided that the pore surface proportion is smallest in the center area of the cylinder and increases toward the two cylinder ends and that the average pore size is essentially constant over the length of the cylinder.

The process according to the invention for producing a crankcase for an internal-combustion engine having at least one cylinder particularly has the following steps:

(a) casting of the crankcase of a light-metal material, such as an aluminum silicon alloy, by die casting (especially hypoeutectic aluminum silicon alloys are considered for this purpose);

(b) subsequently, precision-turning the inner face of the at least one cylinder;

(c) then, roughening the precision-turned inner face; and (d) finally, applying a coating to the roughened inner face, which coating forms a running surface for a piston to be inserted into the cylinder. According to the invention, the application of the coating takes place in such a manner that a coating with a plurality of pores is created, the average pore size and/or the pore surface proportion varying over the length of the cylinder.

Other objects, advantages and novel features of the present invention will become apparent from the following detailed description of one or more preferred embodiments when considered in conjunction with the accompanying drawing.

BRIEF DESCRIPTION OF THE DRAWING

The single FIG. 1 is a schematic view of the surface characteristic of an exemplary coating according to the invention.

DETAILED DESCRIPTION OF THE DRAWING

The size of the metal or alloy droplets, which are sprayed on the roughened inner face of the cylinder, is very crucial for the construction of a tribologically advantageous surface layer.

The droplet size should be in the range of between 0.5 μm and 500 μm, preferably in the range of between 0.5 μm and 150 μm, in order to achieve pores that are as finely distributed as possible.

The resulting pores may be considered to be round or more likely oval or of an oblong shape. Starting from a length/width ratio of a pore of more than, for example, 4:1, a pore is considered to be oblong. At a length/width ratio of a pore of less than, for example, 4:1, a pore is considered to be round. The pores are used for the "storage" of the oil and, during the operation of the engine, form "micro pressure chambers".

The "pore surface proportion" is determined in the metallographic cross-section. The term "pore surface proportion" relates to the ratio of the sum, which is determined in the cross-section, of all pore surfaces contained in an evaluated surface to the total evaluated surface.

The ratio of the oblong to the round porosity, by way of the pressure distribution within the pores, very decisively determines the tribological behavior. Optimal tribological characteristics arise, for example, when the ratio of the oblong porosity to the round porosity is in a range of between 0.01 and 2.5.

Over the cylinder length, the pore surface proportion, the pore size and the pore distribution are adapted to the respective requirements of the tribological system such that optimal lubrication conditions or wear characteristics exist in all operating states. During the operation of the internal-combustion engine, the average pore size very decisively determines the carrying capacity of the oil lubrication film between the piston rings and the cylinder running surface.

The layer material has to be selected such that a sufficient wear resistance exists in the mixed-friction area, particularly in the area of the lower or upper cylinder end (bottom and top dead center). Plain steel, especially an FeC material, particularly FeC0,8 material, for example, can be used as the coating material.

The roughness of the precision-turned cylinder surface, i.e., before the roughening, may, for example, be in the range of Rz=2 μm-25 μm.

The roughening of the precision-turned inner face of the cylinder can take place mechanically and/or chemically. A machining of the precision-turned inner face of the cylinder, for example, can be considered. As an alternative or in addition, the precision-turned inner face of the cylinder may also be sandblasted or corundum-blasted. Furthermore, a roughening by high-pressure blasting with a fluid, particularly with an emulsion and/or with a suspension, can be considered.

The roughening causes microscopic undercuts in the cylinder surface. It was found to be particularly advantageous for the roughness of the cylinder surface to be in the range of Rz=30 μm-200 μm after the roughening operation.

A material that is tribologically suitable to be the cylinder running surface will then be applied to the cylinder surface premachined in this manner. The application can take place, for example, by wire arc spraying, in which case fusible metal and alloy droplets are sprayed by way of a fluid jet at a very high speed onto the roughened cylinder surface, whereby a running surface layer is created which has a plurality of pores.

After the application of the coating, the latter is finished by a mechanical honing process.

For the wear resistance, i.e. for the abrasion resistance of the coating, primarily the content of oxides in the coating will be decisive. The oxide formation, which takes place immediately after the spraying-on during the transition from the liquid to the solid phase, can be controlled by varying in a targeted manner the composition of the carrier gas used for spraying on the metal or alloy droplets. Air enriched with nitrogen can be used as the carrier gas. The progression of the hardening process of the cylinder running surface can be adjusted corresponding to a hardness profile varying over the length of the cylinder, in which case the hardness may preferably be in a hardness range between 300 HV and 700 HV.

The round and oblong porosities generated when applying the fusible metal and alloy droplets form a system of cavities in the cylinder surface which are not connected with one another. So that these cavities can act as micro pressure chambers and are sufficiently supplied with oil during a working cycle of the internal-combustion engine, as mentioned above, a finely structured honing will be required as a finishing after the application of the coating.

For ensuring a good carrying capacity of the running path and a good oil supply, the Rpk of the running path should be in the range of between 0.05 μm-2 μm, preferably in the range of between 0.05 μm-1.5 μm, and particularly preferably in the range of between 0.05 μm-1.1 μm.

The Rvk of the cylinder running surface should be in the range of between 0.5 μm-15 μm, preferably in the range of between 1 μm-10 μm.

It is also significant that the characteristic roughness value V0 is in the range of between 0.1 μm-16 μm, preferably in the range of between 0.1 μm-11 μm.

The characteristic roughness value Rk should be in the range of between 0.05 μm-5 μm, preferably in the range of between 0.05 μm-3 μm, and particularly preferably in the range of between 0.1 μm-2 μm.

Only a favorable combination of these characteristic roughness values guaranties optimal tribological characteristics of the honed cylinder surface.

Compared to conventional hypereutectic aluminum silicon materials, a coating applied according to the invention has a clearly improved resistance to wear.

In comparison to conventional cylinders, into which grey cast iron liners are inserted, a lower cylinder distortion can be observed because the applied coating essentially does not have its own rigidity and adapts itself to the structure of the cylinder substrate. This, in turn, permits a reduction of the piston ring pressures, which finally results in a reduction of frictional losses. The intrinsic micro pressure chambers in the coating cause a higher hydrodynamic friction ratio, which also has a positive effect on the friction loss.

In comparison to the grey cast iron liners frequently used today, a coating according to the invention has an extremely high resistance to corrosion, specifically also at high combustion temperatures and in the case of acidic media because of an improved heat removal from the cylinder surface into the cooling medium.

In comparison to grey cast iron liners, the intrinsic micro pressure chambers permit a finer surface structuring while the lubricating effect is the same, and therefore have a friction advantage.

The combination of light-metal die casting with a Fe coating therefore results in a cost advantage. Since the previously used grey cast iron liners can be eliminated, a weight advantage and a higher wear resistance can also be achieved.

FIG. 1 is a schematic view of a laid-out representation of the smoothly honed surface (running surface) of a cylinder of an internal-combustion engine. The running surface may be more likely to have "oblong porosities" and more likely to have "round porosities".

Starting from a length/width ratio (x1:x2) of a pore of more than, for example, 4:1, a pore is considered to be oblong; below that, a pore is considered to be round.

The pore surface proportion is determined in the metallographic intersection. The pore surface proportion is computed from the ratio of the sum of all pore surfaces to the total evaluated surface A. In an approximate manner, the pore surface of a pore can be fixed as a "rectangle"; i.e. pore surface≈x1*x2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of producing a crankcase for an internal-combustion engine having at least one cylinder, the method comprising the acts of:

casting the crankcase of a light-metal material;

precision-turning an inner face of the cylinder of the crankcase;

roughening the-precision-turned inner face;

applying a coating to the roughened inner face with a plurality of pores, an average pore size and a pore surface proportion being predeterminedly defined so as to vary over a length of the cylinder, said coating forming a running surface for a piston, wherein the roughened inner face of the cylinder has a surface roughness approximately in a range of Rz=30 μm to 200 μm.

2. The method according to claim 1, wherein the light-metal material is an Al—Si alloy.

3. The method according to claim 1, wherein the casting is a die casting of the crankcase.

4. The method according to claim 1, wherein the act of roughening is carried out by at least one of a mechanical process and a chemical process.

5. The method according to claim 1, wherein the act of roughening takes place by one of:

machining;

sandblasting or corundum-blasting; and high-pressure blasting via a fluid.

6. The method according to claim 1, wherein the act of applying the coating is carried out by wire arc spraying of fusible droplets.

7. The method according to claim 6, wherein the fusible droplets are sprayed via a carrier gas onto the roughened inner face of the cylinder, said carrier gas consisting essentially of air enriched with nitrogen.

8. The method according to claim 1, wherein the applied coating is an iron-coating.

9. The method according to claim 8, wherein the iron-based coating is an FeC coating.

10. The method according to claim 1, wherein an oxide proportion of the coating varies, such that a hardness of the coating varies over the length of the cylinder approximately between 300 HV and 700 HV.

11. The method according to claim 1, wherein the formed running surface is finished via a mechanical honing process.

12. The method according to claim 11, wherein the finished honed running surface has a roughness value of at least one of:

(a) Rpk is in a range of between 0.05 μm-2 μm;

(b) Rvk is in a range=0.5 μm-15 μm;

(c) V0 is in a range of between 0.1 μm-16 μm; and (d) Rk is in a range of between 0.05 μm-5 μm.

13. The method according to claim 1, wherein the cylinder has an upper end near a cylinder head and a lower end near an oil pan, and further wherein the size of the pores and/or the pore surface proportion decreases from the lower end in a direction toward the upper end.

14. The method according to claim 1, wherein the cylinder has an upper end near a cylinder head, a lower end near an oil pan, and a center area situated between the upper and lower ends, and further wherein the size of the pores and/or the pore surface proportion are largest in a center in the center area and decrease in directions toward both the upper and lower ends.

15. The method according to claim 1, wherein the pore surface proportion increases from an upper cylinder end in a direction toward a lower cylinder end, and further wherein the average pore size is essentially constant over the length of the cylinder.

16. The method according to claim 1, wherein the pore surface is smallest in a center area of the cylinder and increases in a direction toward upper and lower cylinder ends, and further wherein the average pore size is essentially constant over the length of the cylinder.

17. The method according to claim 1, wherein some of the plurality of pores are oblong pores and some are round pores, the oblong pores being pores that have a length to width ratio of more than 4:1, the round pores being pores that have a length to width ratio of at most 4:1, and a ratio of the oblong pores to the round pores ranges between 0.1 and 2.5.

18. An internal-combustion engine, comprising:

a crankcase having at least one cylinder operatively configured to accommodate a piston, wherein an inner face of the cylinder has a coating forming a running surface for the piston, the coating having a plurality of pores with an average size of the pores and a pore surface proportion being predeterminedly defined so as to vary over the length of the cylinder, wherein some of the plurality of pores are oblong pores and some are round pores, the oblong pores being pores that have a length to width ratio of more than 4:1, the round pores being pores that have a length to width ratio of at most 4:1, and a ratio of the oblong pores to the round pores ranges between 0.1 and 2.5.

19. The internal-combustion engine according to claim 18, wherein the applied coating is an iron-based coating.

20. The internal-combustion engine according to claim 19, wherein the iron-based coating is an FeC coating.

21. The internal-combustion engine according to claim 18, wherein an oxide proportion of the coating varies, such that a hardness of the coating varies over the length of the cylinder approximately between 300 HV and 700 HV.

22. The internal-combustion engine according to claim 18, wherein the formed running surface is a finished honed running surface.

23. The internal-combustion engine according to claim 22, wherein the finished honed running surface has a roughness value of at least one of:

(a) Rpk is in a range of between 0.05 μm-2 μm;

(b) Rvk is in a range=0.5 μm-15 μm;

(c) V0 is in a range of between 0.1 μm-16 μm; and (d) Rk is in a range of between 0.05 μm-5 μm.

24. The internal-combustion engine according to claim 18, wherein the cylinder has an upper end near a cylinder head and a lower end near an oil pan, and further wherein the size of the pores and/or the pore surface proportion decreases from the lower end in a direction toward the upper end.

25. The internal-combustion engine according to claim 18, wherein the cylinder has an upper end near a cylinder head, a lower end near an oil pan, and a center area situated between the upper and lower ends, and further wherein the size of the pores and/or the pore surface proportion are largest in a center in the center area and decrease in directions toward both the upper and lower ends.

26. The internal-combustion engine according to claim 18, wherein the pore surface proportion increases from an upper cylinder end in a direction toward a lower cylinder end, and further wherein the average pore size is essentially constant over the length of the cylinder.

27. The internal-combustion engine according to claim 18, wherein the pore surface is smallest in a center area of the cylinder and increases in a direction toward upper and lower cylinder ends, and further wherein the average pore size is essentially constant over the length of the cylinder.

* * * * *